US006846200B1

(12) United States Patent
Hsu

(10) Patent No.: US 6,846,200 B1
(45) Date of Patent: Jan. 25, 2005

(54) STRUCTURE FOR A MODULE CONNECTOR

(75) Inventor: Wen-Lung Hsu, Chang Hua Hsien (TW)

(73) Assignee: Golden Bridge Electech Inc., Taipei (TW)

( * ) Notice: Subject to any disclaimer, the term of this patent is extended or adjusted under 35 U.S.C. 154(b) by 0 days.

(21) Appl. No.: 10/820,801

(22) Filed: Apr. 9, 2004

(51) Int. Cl.[7] ..... H01R 13/60
(52) U.S. Cl. ..... 439/540.1; 439/687
(58) Field of Search ..... 439/540.1, 607–609, 439/686, 687, 695, 696, 701

(56) References Cited

U.S. PATENT DOCUMENTS 6,247,978 B1 * 6/2001 Wu ..... 439/879
6,699,075 B1 * 3/2004 Ko ..... 439/610
6,722,924 B1 * 4/2004 Zhou et al. ..... 439/608

* cited by examiner

*Primary Examiner*—Tho D. Ta
*Assistant Examiner*—James R. Harvey
(74) *Attorney, Agent, or Firm*—Troxell Law Office PLLC

(57) ABSTRACT

The present invention is related to an improved structure for a module connector for assembling on a case of a computer and comprises: a case has a lower cover and an upper cover, the upper cover and the lower cover have a second containing slot and a first containing slot individually for different connectors, the first and second containing slots construct several containing spaces, the first containing slot has a stopping portion for blocking connectors and hook portions for linking two sides of each connector up; a metal member wraps around an end surface of the case, the metal member is established plural homologous holes corresponding to the containing spaces of the case, the metal member has a plurality of flexible touching members individually arranged into cross-section slots of the containing spaces; hence stable assembly for the case and the connectors is made, and channels of the module connector for electrically connecting outside are effectively shielded.

3 Claims, 6 Drawing Sheets

STRUCTURE FOR A MODULE CONNECTOR

FIELD OF THE INVENTION

The present invention relates to an improved structure for a module connector, especially to the structure for stably assembling a case and a connector of the present invention; further that an electrical connecting channel for the module connector linking up outside being shielded effectively.

BACKGROUND OF THE INVENTION

Referring to FIGS. 5 and 6, which is the skill in prior arts and comprise: a case 4, which consists of a lower case 41 and an upper case 42, an end of the lower case 41 is with two first fillister sets 411, each of the first fillister set having two fillisters, plural holes 412 through a surface of the lower case 41 and two clasps 413 are within the two fillisters, two sides of an end of the lower case 41 are independently installed connecting portions 414, two sides of the lower case 41 are with two fixing portions 415 individually, another end of the lower case 41 has two thread holes 416; an end of the upper case 42 has two second fillister sets 421 corresponding the first fillister sets 411 of the lower case 41, a plurality of containing rooms are thus formed by the first fillister sets 411 and the second fillister sets 421, each of two sides of an end of the upper case 42 has a buckling portion 422 corresponding each of the connecting portions 414 for working together, each of two sides of the upper case 42 has a fixing portion 423 corresponding each of the two fixing portions 415 of the lower case 41; a metal cover 5, which wraps around an end of the case 4 and has a plurality of notches 51 corresponding the containing rooms, the metal cover 5 has several flexible members 52 to restrict the holes 412.

A plurality of connectors 6 are arranged into the containing rooms while in assembly, and the two clasps 413 of the first fillister sets 411 of the lower case 41 hook up two sides of two connectors 6 therein, then the buckling portion 422 of the upper case 42 fastens the connecting portions 414 of the lower case 41 each other, the metal cover 5 may then put around an end of the case 4 to make the flexible members 52 of the metal cover 5 be restricted in the holes 412 of the lower case 41 and connect to two connectors 6 therein.

Although the above structure is a module connector, the metal cover 5 is only pushed into an end of the case 4 by way of putting around, and a distance is between an end edge of the lower case 41 and the holes 412 so as to that generating compression due to the metal cover 5 withstanding the end edge of the lower case 41 prior to the moment of the metal cover 5 wrapping around the end of the flexible members 52. It is then that the flexible members 52 cannot be put into the holes 412 smoothly to connect the connectors 6 for deriving the condition of difficult assembly, and therefore the shielding effect of the module connector is worse. On the other hand, the connectors 6 connect to the first fillister sets 411 only by way of the clasps 413 hooking up a side of the connectors 6. So, the connectors 6 connect to the clasps 413 unstably at the moment of sorting wires and after assembly, and it is thus the shielding may be worse as well. Obviously a radiator structured as above cannot reach the best effect in practice.

SUMMARY OF THE INVENTION

The primary objective of the present invention is to reach stable assembly by way of relatively staggered hook portions hooking two sides of each connector up, and channels of a module connector for electrically connecting outside by means of metal members and flexible touching members are effectively shielded.

To reach the objective mentioned above, the present invention is to provide an improved structure for a module connector for assembling on a case of a computer and comprises a case having a lower cover and an upper cover and a metal member having a containing portion for wrapping around an end surface of the case, wherein the case is assembled by a plurality of fastening portions and plural slots on edges of the upper cover and the lower cover, the upper cover and the lower cover have a second containing slot and a first containing slot individually for different connectors, the first and second containing slots construct several containing spaces with opens, an end of the first containing slot is a stopping portion for blocking an end of a connector, and two sides of the first containing slot are hook portions for linking two sides of each connector up, each of the hook portions is comparatively mounted on the two sides of the first containing slot by a staggering arrangement, an end surface of the first containing slot is corresponding to the connectors and with cross-section slots, another end surface of the case has plural through holes for wires through the connector, suitable positions on two sides of the case are installed a pair of ears with fixing holes, at least two predefined locations on two surfaces of the case have at least two clipping slots, and a place around each of the clipping slot has at least one protruding block; an end surface of the metal member is established plural homologous holes corresponding to the containing spaces of the case, each of two sides of the metal member is elongated as a wing portion, the wing portion has a wing hole corresponding to the fixing hole of the ear, each of two sides of the wing hole has a flexible piece to connect to the case, an end edge of the metal member is extended as a tip member for inserting into the clipping slot and a buckling portion for fastening the protruding block, an end surface of the metal member has a plurality of flexible touching members individually arranged into the cross-section slots of the containing spaces, and the flexible touching members connect to different connectors, additionally the two end surfaces of the metal member have several forcing flexible members independently. As it can be seen, stable assembly can be approached by way of relatively staggered hook portions hooking two sides of each connector up, and channels of a module connector for electrically connecting outside by means of metal members and flexible touching members are effectively shielded.

DETAILED DESCRIPTION OF THE PREFERRED EMBODIMENTS

Figure 1:
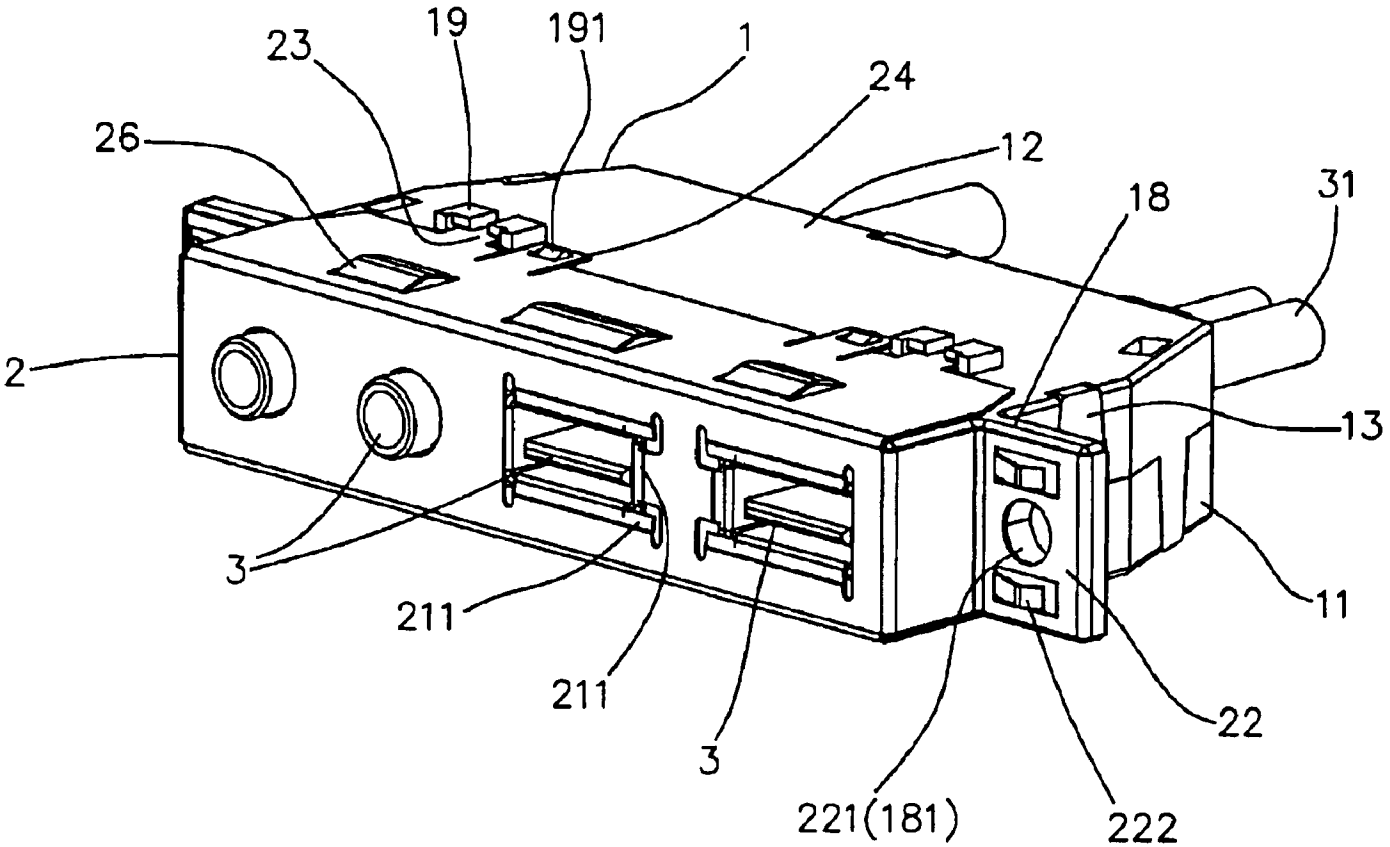
FIG. 1 is a 3-D sketch of an external of the present invention.
Figure 2:
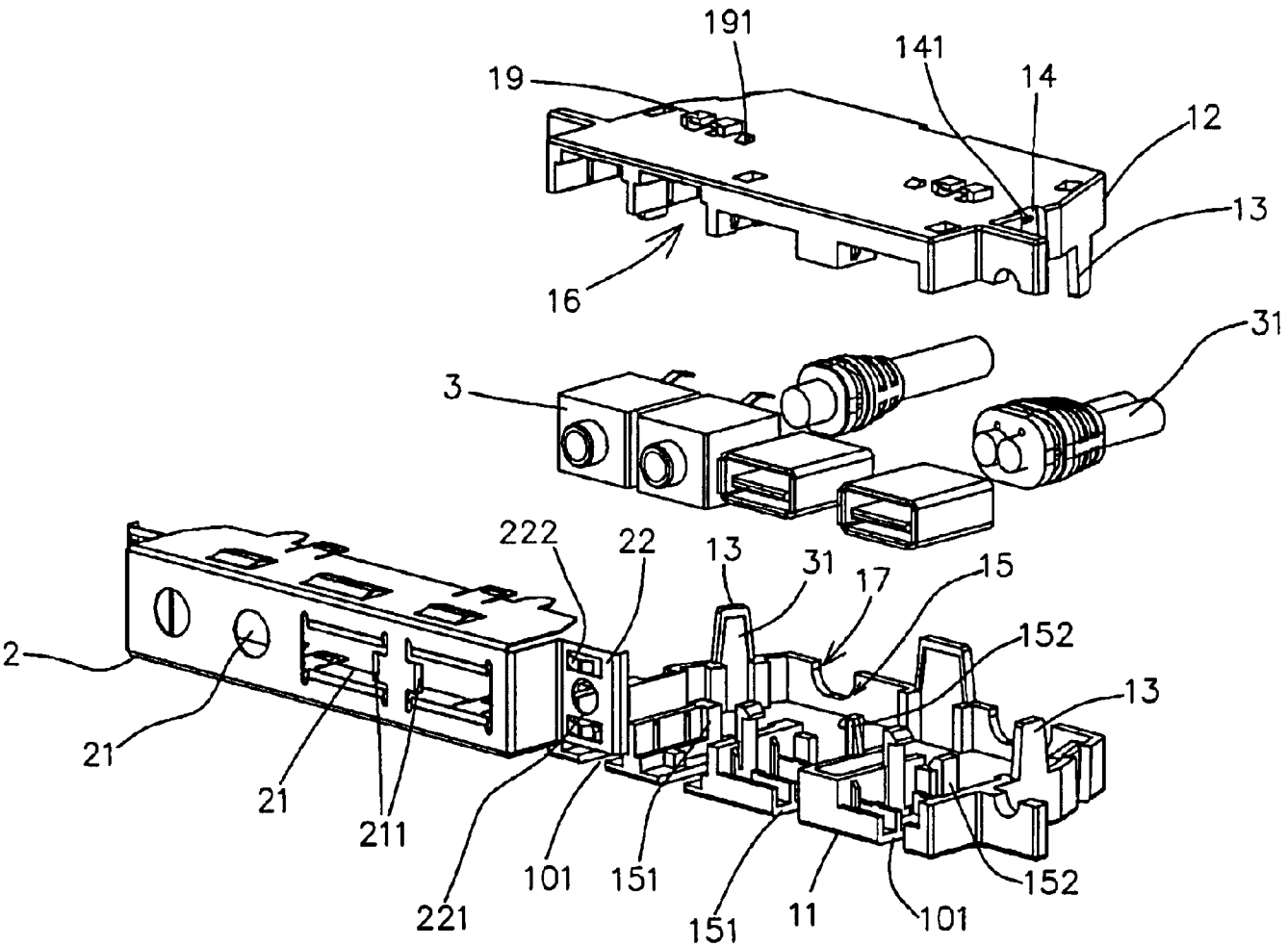
FIG. 2 is a 3-D exploded sketch of the present invention.
Figure 3:
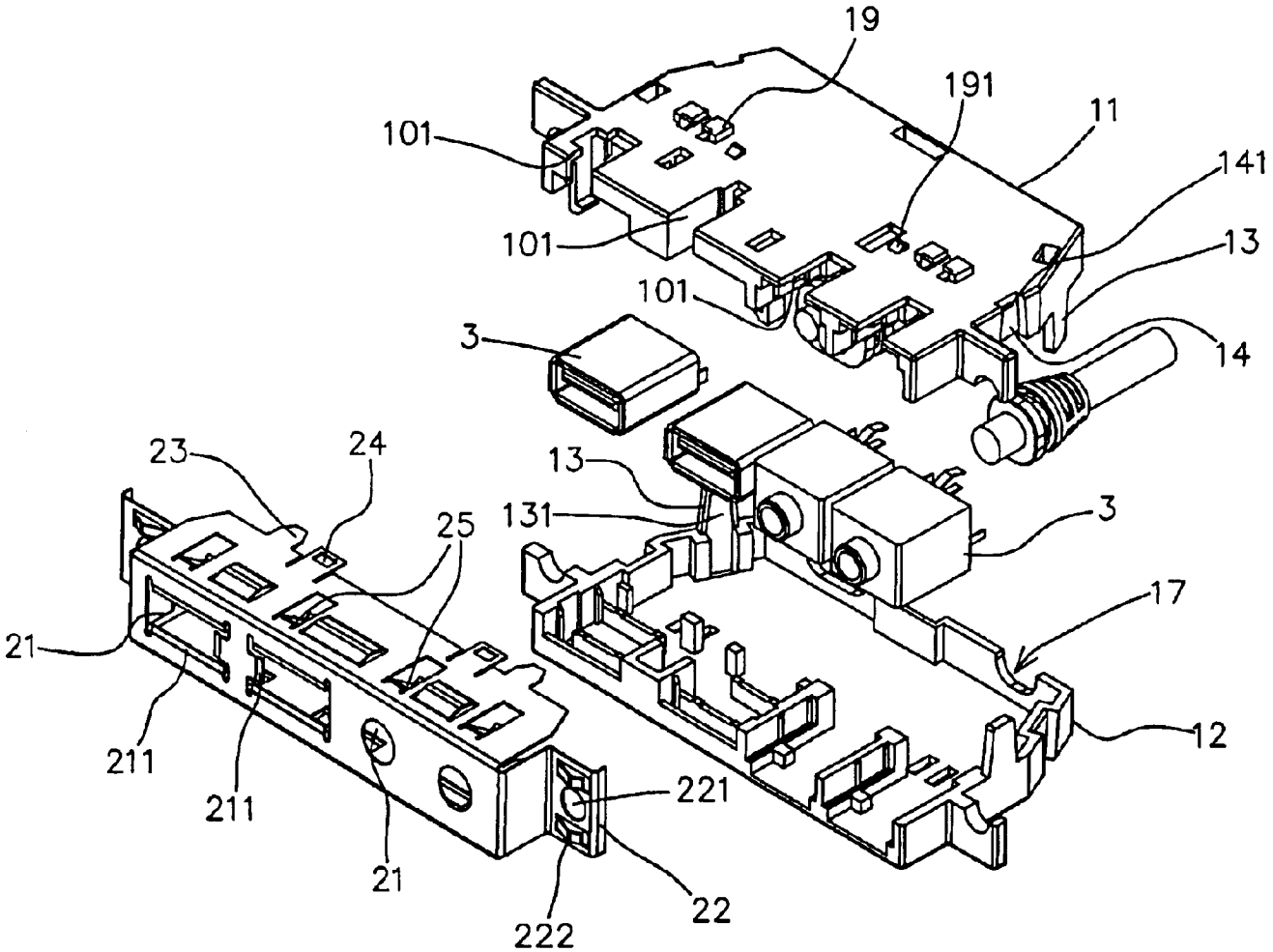
FIG. 3 is another 3-D exploded sketch of the present invention.
Figure 4:
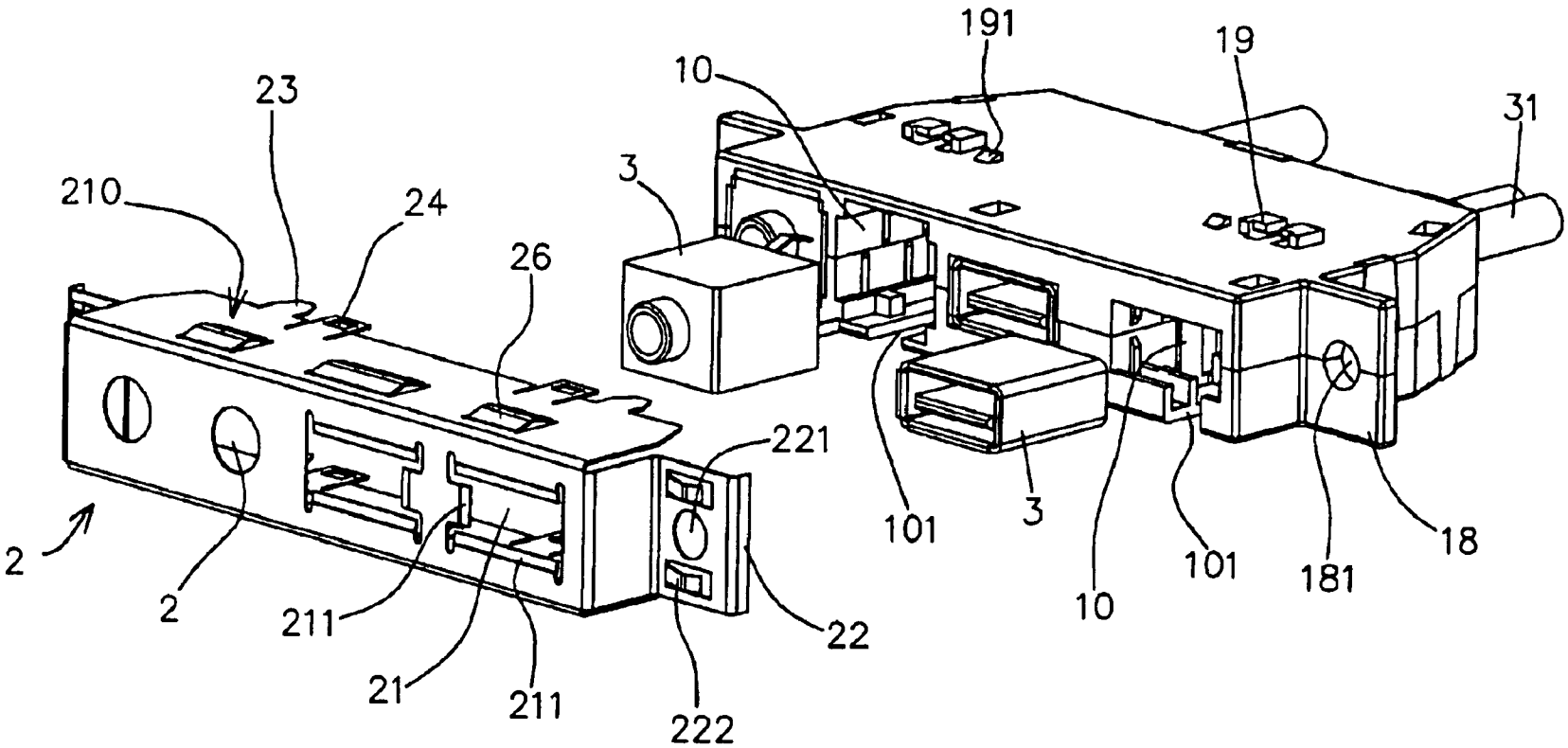
FIG. 4 is a 3-D exploded sketch of a partial of the present invention.
Figure 5:
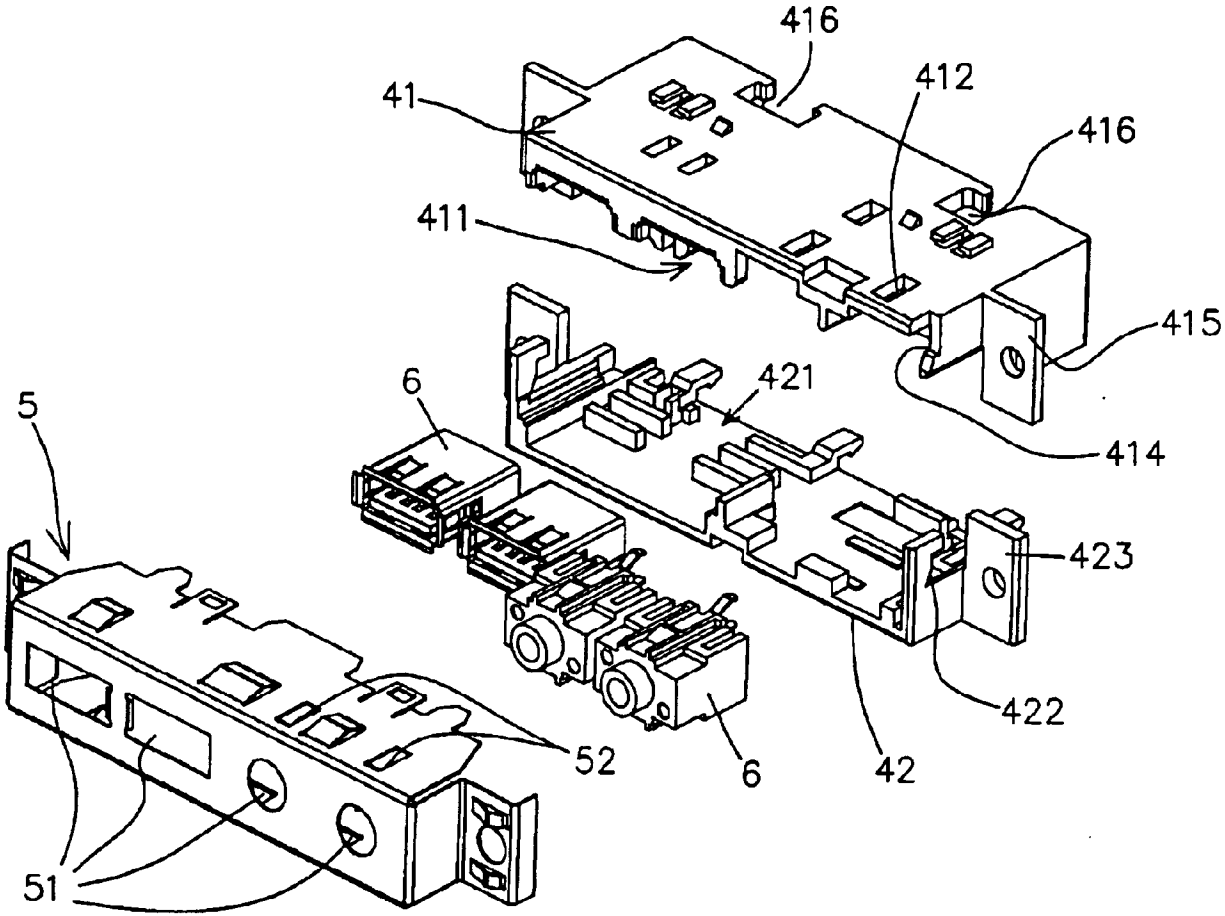
FIG. 5 PRIOR ART
FIG. 5 is a 3-D exploded sketch in prior arts.
Figure 6:
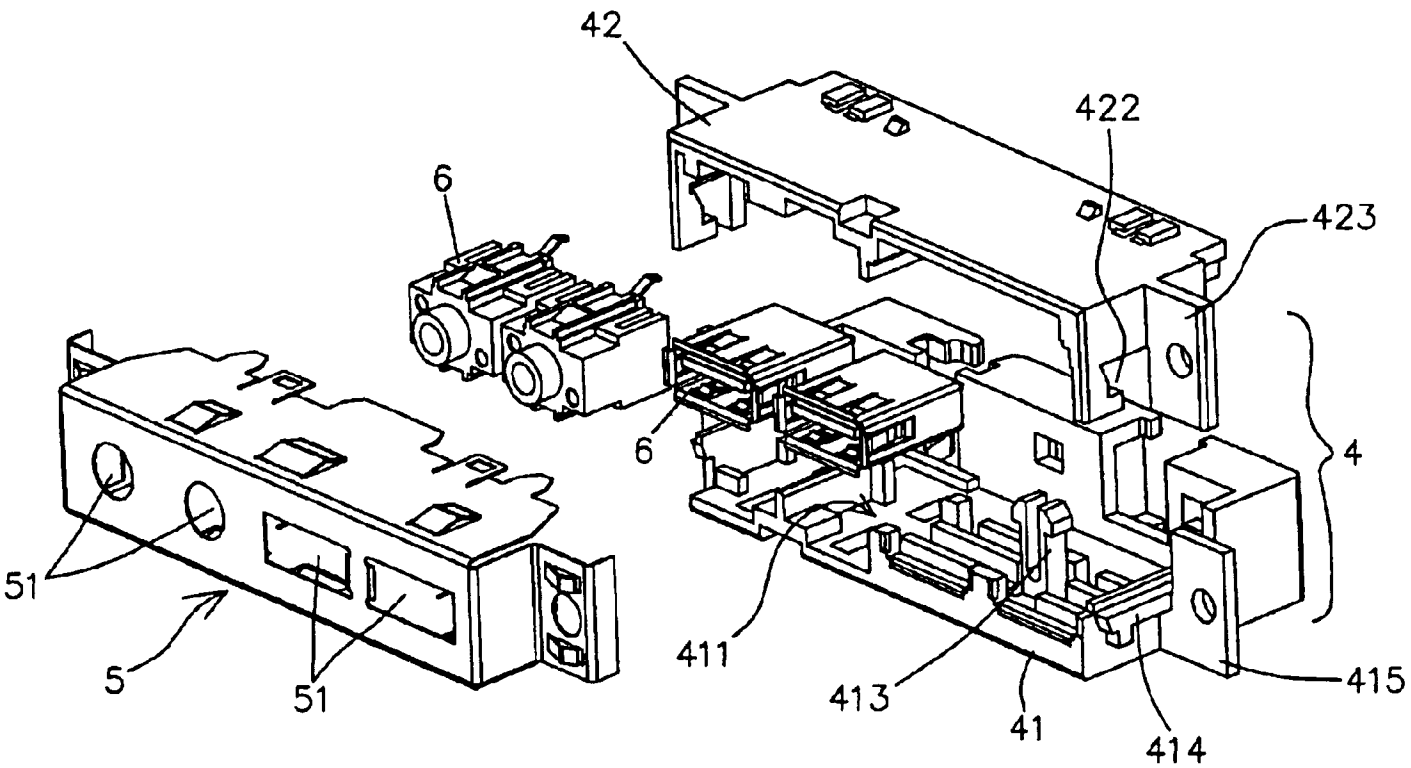
FIG. 6 PRIOR ART
FIG. 6 is another 3-D exploded sketch in prior arts.

Referring to FIGS. 1 to 4, which are a 3-D sketch of an external of the present invention, a 3-D exploded sketch of the present invention, another 3-D exploded sketch of the present invention and a 3-D exploded sketch of a partial of the present invention. As showing in the figures, the present invention is an improved structure for a module connector for assembling on a case of a computer and comprises a case 1 and a metal member 2 for stably assembling the case 1 and connectors 3, further that channels of the module connector for electrically connecting outside are effectively shielded.

The case 1 consists of a lower cover 11 and an upper cover 12 and is assembled by a plurality of fastening portions 13 and plural slots 14 on edges of the lower cover 11 and the upper cover 12, a surface of each fastening portion 13 has a fillister 131, a suitable place of each slot 14 is with a clipping block 141, hence the fillister 131 of the fastening portion 13 and the clipping block 141 of the slot 14 can be fastened together so as to that combining the lower cover 11 and the upper cover 12 to be as the case 1, the lower cover 11 and the upper cover 12 are capable of having a first containing slot 15 and a second containing slot 16 for reserving different connectors 3, the first and second containing slots 15, 16 construct several containing spaces 10 with opens, an end of the first containing slot 15 is a stopping portion 151 for blocking an end of a connector 3, and two sides of the first containing slot 15 are hook portions 152 for linking two sides of each connector 3 up, each of the hook portions 152 is comparatively mounted on the two sides of the first containing slot 15 by a staggering arrangement, an end surface of the first containing slot 15 is corresponding to the connectors 3 and with cross-section slots 101, another end surface of the case 1 has plural through holes 17 for wires 31 through the connector 3, suitable positions on two sides of the case 1 are installed a pair of ears 18 with fixing holes 181, at least two predefined locations on two surfaces of the case 1 have at least two clipping slots 19, and a place around each of the clipping slot 19 has at least one protruding block 19; the metal member 2 has a containing portion 210 for wrapping around an end surface of the case 1, and an end surface of the metal member 2 is established plural homologous holes 21 corresponding to the containing spaces 10 of the case 1, a couple of withstanding portions 211 are located on an edge of the homologous holes 21 for the opens of the connectors 3 touching with, each of two sides of the metal member 2 is elongated as a wing portion 22, the wing portion 22 has a wing hole 221 corresponding to the fixing hole 181 of the ear 18, each of two sides of the wing hole 221 has a flexible piece 222 to connect to the case, an end edge of the metal member 2 is extended as a tip member 23 for inserting into the clipping slot 19 and a buckling portion 24 for fastening the protruding block 191, an end surface of the metal member 2 has a plurality of flexible touching members 25 individually arranged into the cross-section slots 101 of the containing spaces 10, and the flexible touching members 25 connect to different connectors 3, additionally the two end surfaces of the metal member 2 have several forcing flexible members 26 independently so as to generate a force toward outside while the module connector assembling with the case 1. As it can be seen, a brand new and advanced structure for the module connector has been done.

While in assembly, the connectors 3 are equipped with the first containing slot 15 to let the stopping portions 151 of the first containing slot 15 stop the ends of the connectors 3, each of the hook portions 152 with a staggering arrangement buckles each side of the connector 3 for stably mounting the connector 3 on the first containing slot 15, and then to fit the second containing slot 16 of the upper cover 12 with the plural connectors 3 to fasten the fastening portions 13 and plural slots 14 on the edges of the lower and upper covers 11, 12 together as the case 1, simultaneously opening ends of the connectors 3 are corresponding to the opens of the containing spaces 10; continuously the metal member 2 wraps around the end surface of the case 1 by means of the containing portion 210, the homologous holes 21 on the end surface of the metal member 2 are corresponding to the opens of the connectors 3, and the withstanding portions 211 are able to connect to the opens, the tip members 23 and the buckling portions 24 of the metal member 2 fasten with the clipping slots 19 and the protruding blocks 191 due to the wing portions 22 are on the ears 18, therefore the flexible touching members 25 are reserved in the cross-section slots 101 so as to that the engagement of the flexible touching members 25 and the connectors 3 being made.

While using the present invention to assemble a computer case, the fixing holes 181 are matched with the wing holes 221 since the ears 18 are corresponding to the wing portions 22, and the flexible pieces 222 are then connected to the case 1 to make the forcing flexible members 26 generate a force outward for fastening the case 1. Therefore, stable assembly for case 1 can be approached by way of relatively staggered hook portions 152 hooking two sides of each connector 3 up, and channels of the module connector for electrically connecting outside by means of the flexible pieces 222 of the metal member 2, the flexible touching members 25 and the forcing flexible members 26 are effectively shielded.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An improved structure for a module connector for assembling on a case of a computer and comprising a case and a metal member, featuring as:

the case having a lower cover and an upper cover and being assembled by a plurality of fastening portions and plural slots on edges of the upper cover and the lower cover, the upper cover and the lower cover having a second containing slot and a first containing slot individually for different connectors, the first and second containing slots constructing several containing spaces with openings, an end of the first containing slot being a stopping portion for blocking an end of a connector, and two sides of the first containing slot being hook portions for linking two sides of each connector up, each of the hook portions being comparatively mounted on the two sides of the first containing slot by a staggering arrangement, an end surface of the first containing slot being corresponding to the connectors and with cross-section slots, another end surface of the case having plural through holes for wires through the connectors, suitable positions on two sides of the case being installed a pair of ears with fixing holes, at least two predefined locations on two surfaces of the case having at least two clipping slots, and a place around each of the clipping slot having at least one protruding block; and the metal member having a containing portion for wrapping around an end surface of the case, an end surface of the metal member being established plural homologous holes corresponding to the containing spaces of the case, each of two sides of the metal member being elongated as a wing portion, the wing portion having a wing hole corresponding to the fixing hole of the ear, each of two sides of the wing hole having a flexible piece to connect to the case, an end edge of the metal member being extended as a tip member for inserting into the clipping slot and a buckling portion for fastening the protruding block, an end surface of the metal member having a plurality of flexible touching members individually arranged into the cross-section slots of the containing spaces, and the flexible touching members connecting to different connectors, additionally the two end surfaces of the metal member having several forcing flexible members independently.

2. The improved structure for a module connector as cited in claim 1, wherein a surface of each fastening portion has a fillister, a suitable place of each slot is with a clipping block, the fillister of the fastening portion and the clipping block of the slot can be fastened together.

3. The improved structure for a module connector as cited in claim 1, wherein a couple of withstanding portions are located on an edge of the homologous holes for the openings of the connectors touching with the metal member.

* * * * *